US007547124B2

(12) United States Patent
Chang et al.

(10) Patent No.: US 7,547,124 B2
(45) Date of Patent: Jun. 16, 2009

(54) LED LAMP COOLING APPARATUS WITH PULSATING HEAT PIPE

(75) Inventors: Chang-Shen Chang, Taipei Hsien (TW); Juei-Khai Liu, Taipei Hsien (TW); Chao-Hao Wang, Taipei Hsien (TW); Hsien-Sheng Pei, Taipei Hsien (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/684,461

(22) Filed: Mar. 9, 2007

(65) Prior Publication Data

US 2008/0117637 A1 May 22, 2008

(30) Foreign Application Priority Data

Nov. 17, 2006 (CN) ..... 200610156914

(51) Int. Cl.
*F21V 29/00* (2006.01)

(52) U.S. Cl. ..... 362/373; 362/294; 362/800

(58) Field of Classification Search ..... 362/294, 362/373

See application file for complete search history.

(56) References Cited

U.S. PATENT DOCUMENTS 6,517,221 B1 * 2/2003 Xie ..... 362/373
6,910,794 B2 * 6/2005 Rice ..... 362/547
7,331,691 B2 * 2/2008 Livesay et al. ..... 362/294
2003/0037910 A1 2/2003 Smyrnov
2005/0092469 A1 5/2005 Huang
2006/0146496 A1 7/2006 Asfia et al.
2008/0043479 A1 * 2/2008 Wang ..... 362/373
2008/0055908 A1 * 3/2008 Wu et al. ..... 362/294

FOREIGN PATENT DOCUMENTS

CN 1341966 A 3/2002
CN 1684252 10/2005
TW 1263008 10/2006

* cited by examiner

*Primary Examiner*—Anabel M Ton
(74) *Attorney, Agent, or Firm*—Frank R. Niranjan

(57) ABSTRACT

An LED lamp cooling apparatus (10) includes a substrate (11), a plurality of LEDs (13) electrically connected with the substrate, a heat sink (19) for dissipation of heat generated by the LEDs and a pulsating heat pipe (15) thermally connected with the heat sink. The pulsating heat pipe includes a plurality of heat receiving portions (154) and a plurality of heat radiating portions (155), and contains a working fluid (153) therein. The substrate is attached to the heat receiving portions of the pulsating heat pipe and the heat sink is attached to the heat radiating portions of the pulsating heat pipe. The heat generated by the LEDs is transferred from the heat receiving portions to the heat radiating portions of the pulsating heat pipe through pulsation or oscillation of the working fluid in the pulsating heat pipe.

18 Claims, 18 Drawing Sheets

LED LAMP COOLING APPARATUS WITH PULSATING HEAT PIPE

BACKGROUND OF THE INVENTION

1. Field of the Invention

The present invention relates generally to cooling apparatus for use with light emitting diodes (LEDs), and more particularly to an LED lamp cooling apparatus using a pulsating heat pipe for improving heat dissipation.

2. Description of Related Art

With the continuing development of scientific technology and the raise of people's consciousness of energy saving, LEDs have been widely used in the field of illumination due to their small volume in size and high efficiency. It is well known that LEDs generate heat when they emit light. If this heat is not quickly removed, these LEDs may overheat, and thus their work efficiency and service life can be significantly reduced. This is particularly true when LEDs are used in an LED lamp in which the LEDs are arranged side-by-side in large density.

A traditional method of solving the heat dissipation problem is using a plurality of cooling fins attached to a base of the lamp. The heat generated by the LEDs is conducted to the cooling fins via the base, and then dissipated into ambient air by the cooling fins. However, this method is only suitable for low power consumption LED lamps, and is not suitable for high power consumption LED lamps. Another method of heat dissipation is using a conventional heat pipe or a loop heat pipe. The heat dissipation efficiency of these heat pipes, however, is limited by their low heat flux per unit area, and consequently these heat pipes are easy to dry out when subjected to a large amount of heat.

Therefore, it is desirable to provide an LED lamp cooling apparatus which can overcome the above-mentioned disadvantages.

SUMMARY OF THE INVENTION

The present invention relates to an LED lamp cooling apparatus. According to an embodiment of the present invention, the cooling apparatus includes a substrate, a plurality of LEDs mounted on the substrate, a heat sink for dissipation of heat generated by the LEDs and a pulsating heat pipe thermally connected with the heat sink. The pulsating heat pipe includes a plurality of heat receiving portions and a plurality of heat radiating portions, and contains a working fluid therein. The substrate is attached to the heat receiving portions of the pulsating heat pipe and the heat sink is attached to the heat radiating portions of the pulsating heat pipe. The heat generated by the LEDs is transferred from the heat receiving portions to the heat radiating portions of the pulsating heat pipe through pulsation or oscillation of the working fluid in the pulsating heat pipe.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present LED cooling apparatus can be better understood with reference to the following drawings. The components in the drawings are not necessarily drawn to scale, the emphasis instead being placed upon clearly illustrating the principles of the present LED cooling apparatus.

Moreover, in the drawings, like reference numerals designate corresponding parts throughout the several views.

DETAILED DESCRIPTION OF THE INVENTION

Figure 1A:
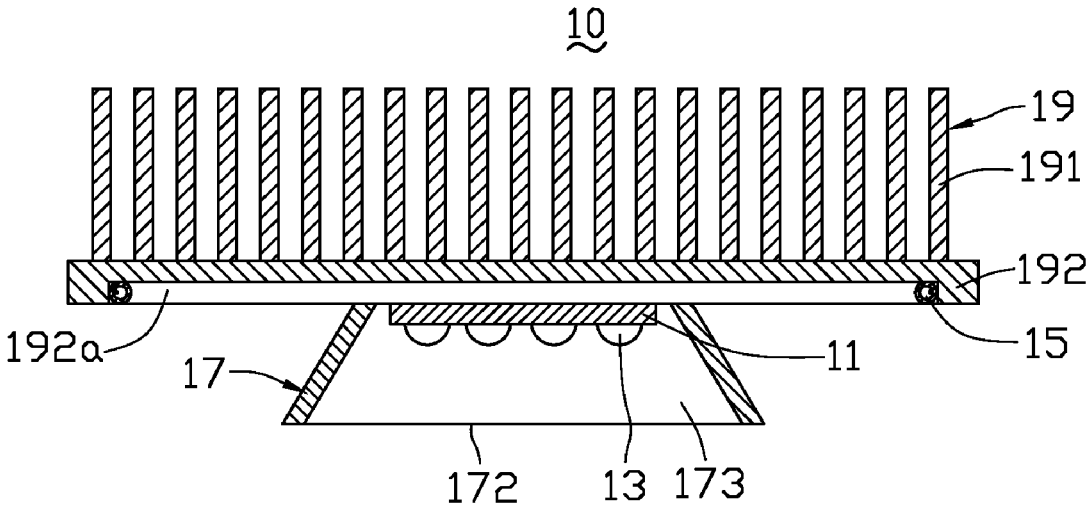
FIG. 1A is a cross-sectional view of an LED lamp cooling apparatus in accordance with a first embodiment of the present invention.
Figure 1B:
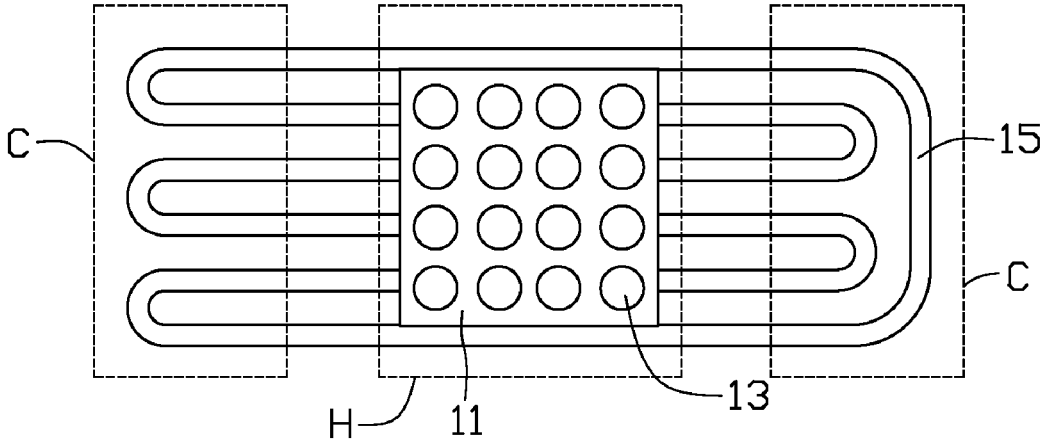
FIG. 1B is a bottom plan view of a pulsating heat pipe and a substrate of the LED lamp cooling apparatus of FIG. 1.

FIGS. 1A-1B illustrate an LED lamp cooling apparatus 10 in accordance with a first embodiment of the present invention. The cooling apparatus 10 includes a substrate 11, a plurality of LEDs 13 electrically connected with the substrate 11, a pulsating heat pipe 15 thermally connected with the substrate 11, a reflector 17 enclosing the LEDs 13 and the substrate 11, and a heat sink 19 attached to the pulsating heat pipe 15 for dissipating heat generated by the LEDs 13 to ambient atmosphere. Shape and structure of the heat sink 19 can be diverse. In this embodiment, the heat sink 19 includes a planar base 192 and a plurality of cooling fins 191 extending upwardly from the base 192.

The substrate 11 of the cooling apparatus 10 is a circuit board preferably made of a highly thermally conductive material. The substrate 11 may be a metal-based circuit board, such as a metal core printed circuit board (MCPCB), to improve thermal conductivity. Alternatively, the substrate may be a ceramic circuit board.

The pulsating heat pipe 15 is disposed between the substrate 11 and the base 192 of the heat sink 19 for thermally connecting the substrate 11 with the heat sink 19. The pulsating heat pipe 15 is embedded in a groove 192*a* defined in a bottom surface of the base 192. The reflector 17 is in the shape of a cup, and is used to converge the light emitted by the LEDs 13 towards objects that should be illuminated. The reflector 17 can be made of a material of high thermal conductivity. A heat dissipation structure such as a plurality of cooling fins can be attached to the outer surface of the reflector 17 to further improve heat dissipation. The reflector 17 defines a chamber 173 therein for enclosing the LEDs 13 and the substrate 11, and an opening 172 at open end thereof for allowing the light emitted by the LEDs 13 to exit. An inner surface of the reflector 17 has a reflecting material applied thereon, so that the light emitted from the LEDs 13 can be reflected and guided towards the opening 172.

Figure 1C:
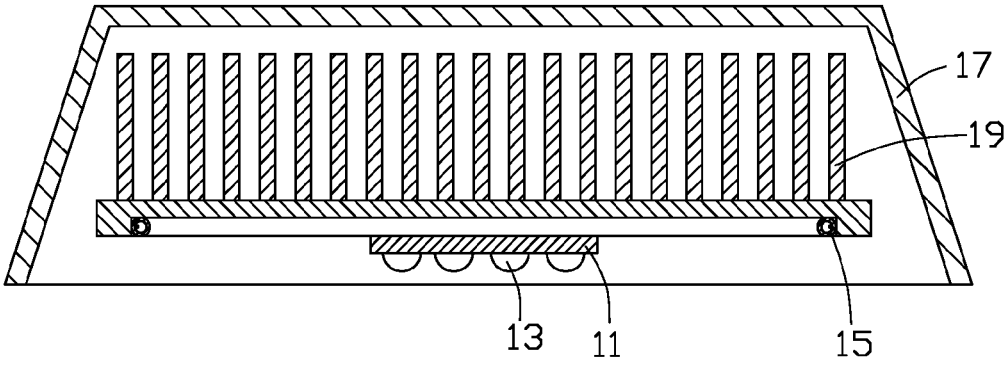
FIG. 1C is a cross-sectional view of an LED lamp cooling apparatus in accordance with a second embodiment of the present invention.
Figure 1D:
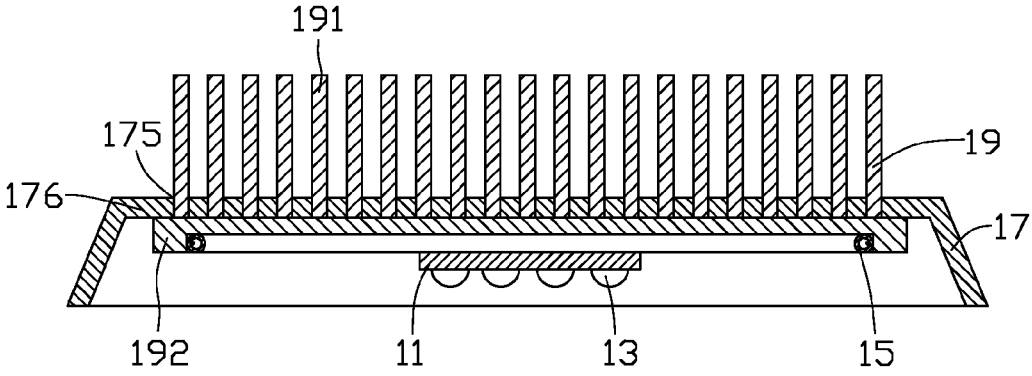
FIG. 1D is a cross-sectional view of an LED lamp cooling apparatus in accordance with a third embodiment of the present invention.

FIG. 1C illustrates a cooling apparatus in accordance with a second embodiment of the present invention. In this embodiment, the reflector 17 is disposed around the system including the substrate 11, the LEDs 13, the pulsating heat pipe 15 and the heat sink 19. In other words, the heat sink 19, together with the pulsating heat pipe 15 attached thereto, is enclosed within the chamber 173 of the reflector 17. FIG. 1D illustrates a cooling apparatus in accordance with a third embodiment of the present invention. In this embodiment, the reflector 17 defines a plurality of holes 175 in a bottom 176 thereof corresponding to the fins 191 of the heat sink 19, so that the fins 191 can pass through the corresponding holes 175 and extend out of the reflector 17. Namely, a part of the heat sink 19, i.e., the base 192, is enclosed in the reflector 17, and another part of the heat sink 19, i.e., the fins 191, extends out of the reflector 17.

Figure 2:
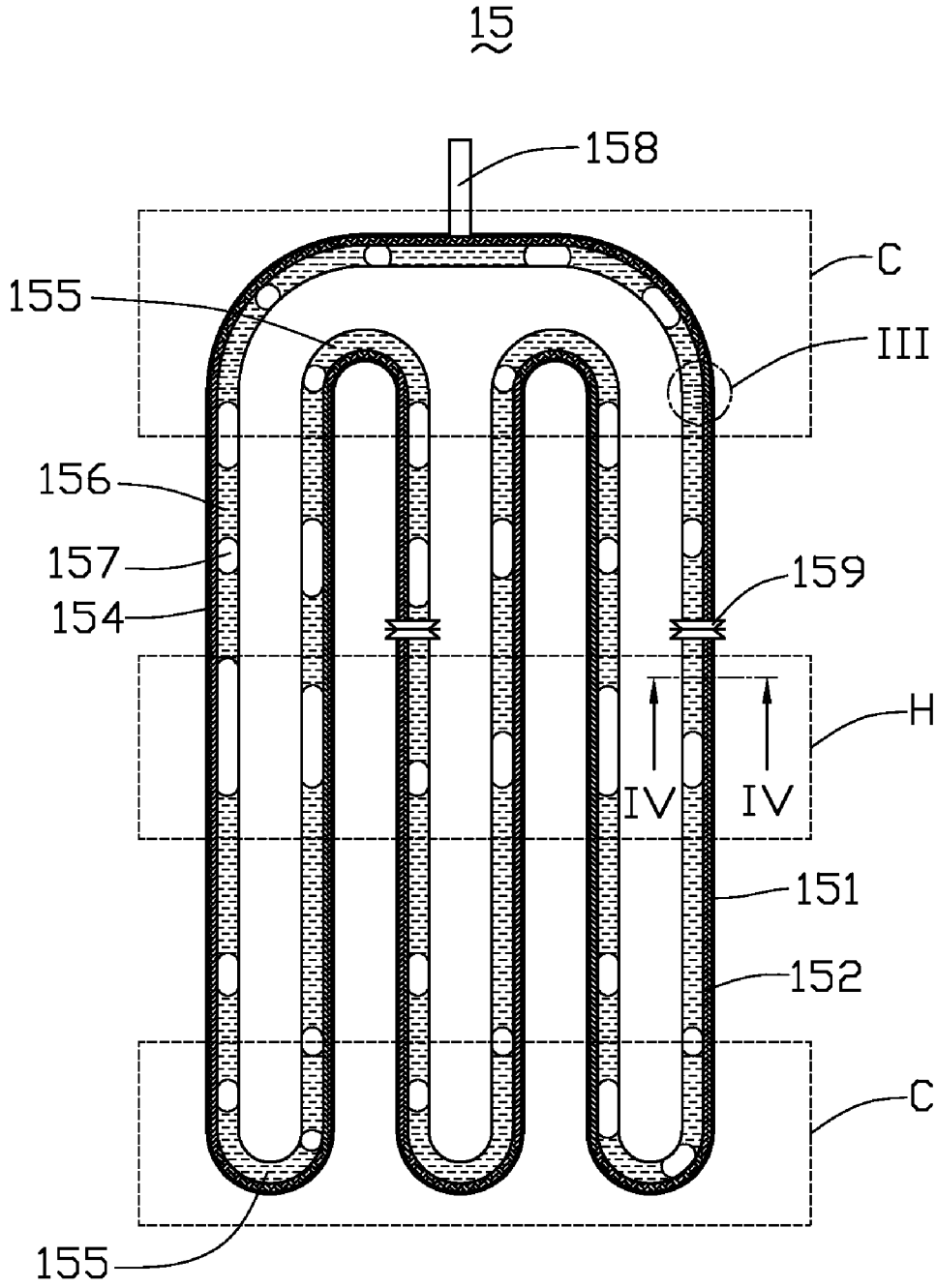
FIG. 2 is a schematic view showing an inner structure of the pulsating heat pipe of FIG. 1B.
Figure 3:
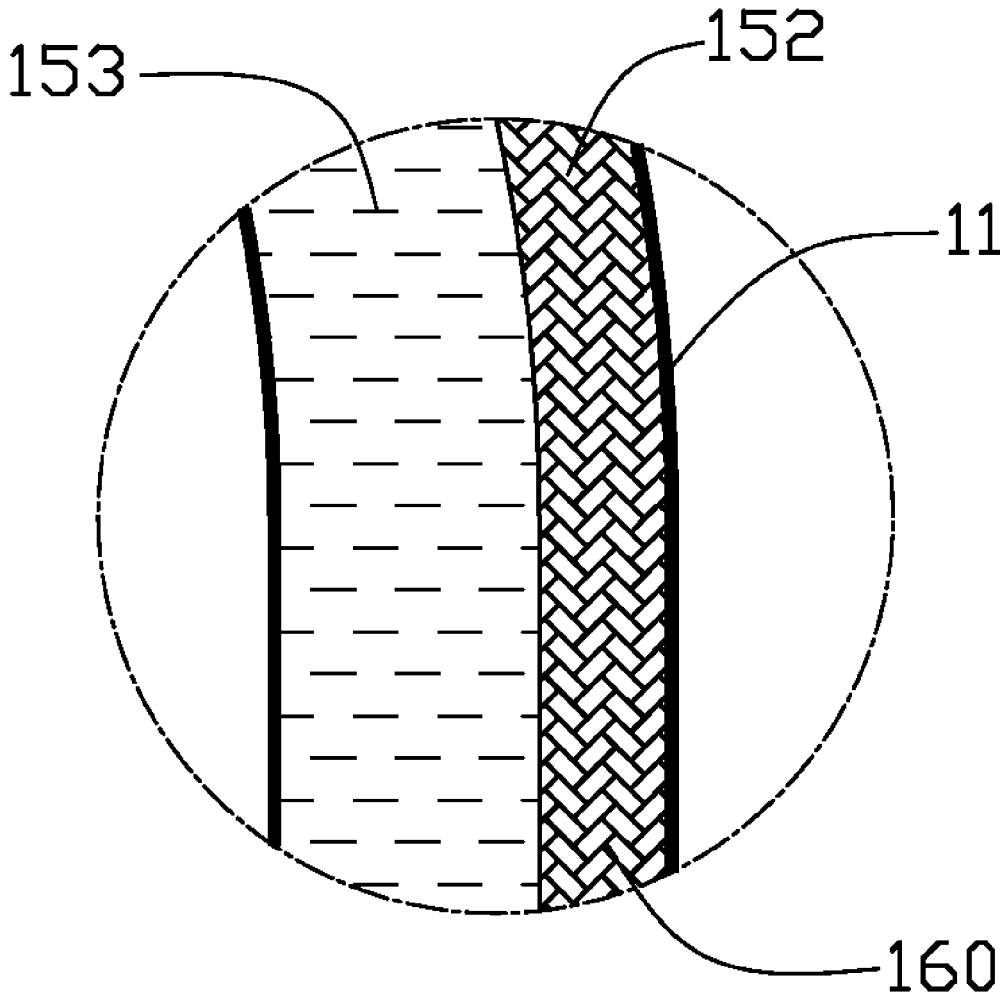
FIG. 3 is an enlarged view of a circled portion III of the pulsating heat pipe of FIG. 2.
Figure 4:
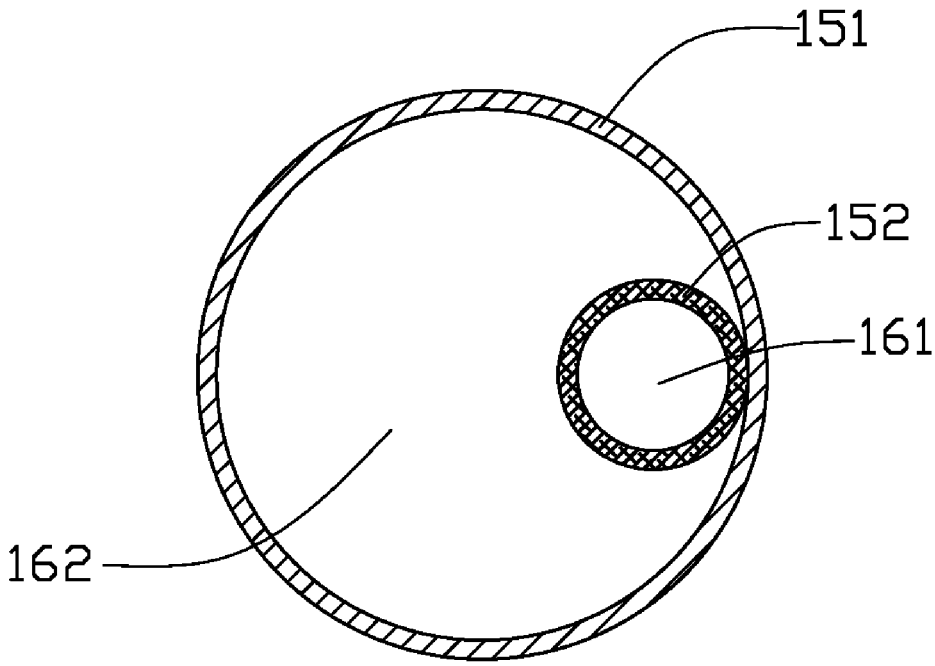
FIG. 4 is an enlarged, cross-sectional view of the pulsating heat pipe of FIG. 2, taken along line IV-IV thereof.

Referring to FIGS. 2-4, the pulsating heat pipe 15 includes a serpentine, elongated capillary tube 151, a flexible interwoven artery mesh 152 disposed within the capillary tube 151, and a predetermined quantity of condensable bi-phase working fluid 153 (shown in FIG. 3) contained in the capillary tube 151 and the artery mesh 152.

Figure 5:
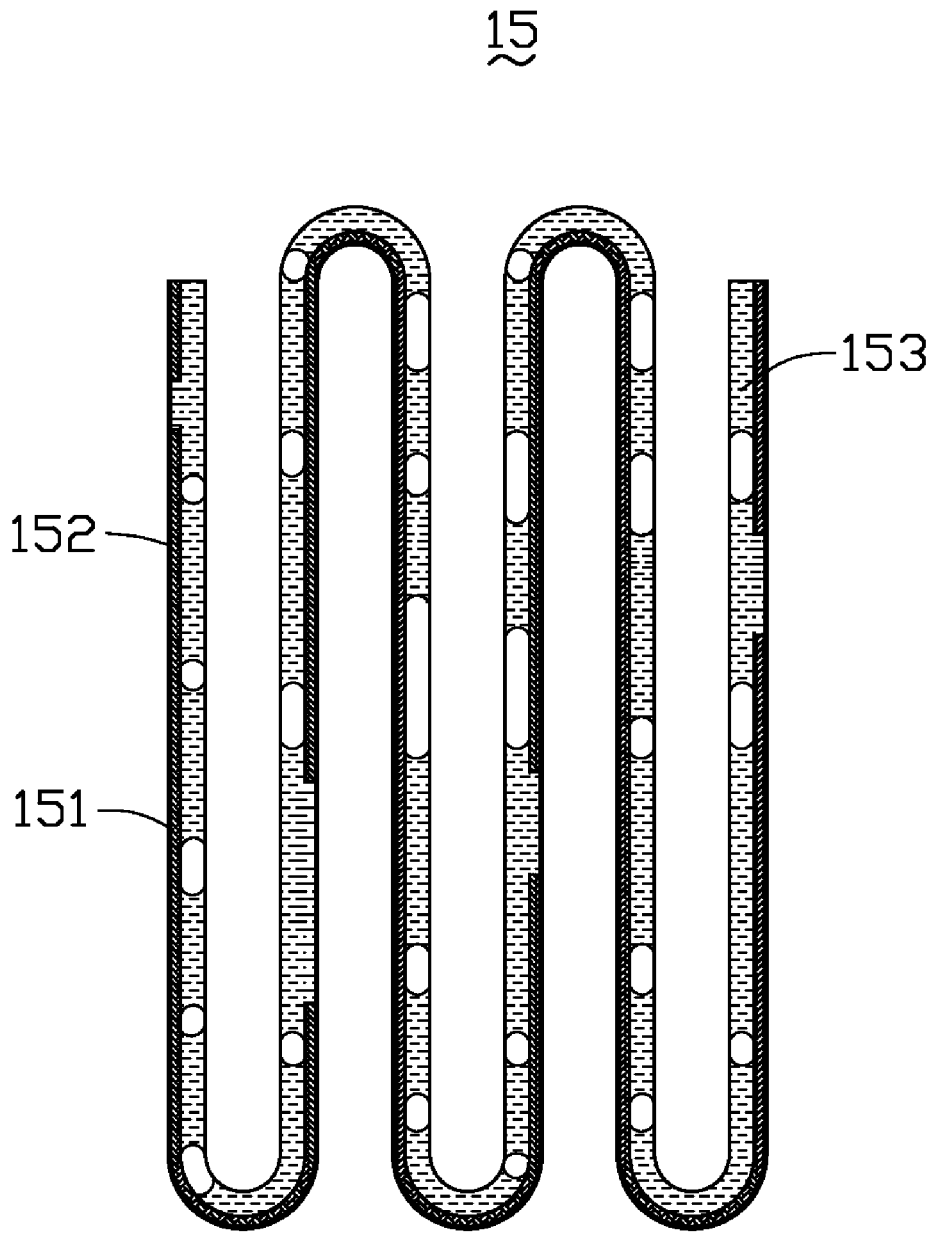
FIG. 5 is a schematic view showing an inner structure of a pulsating heat pipe in accordance with another embodiment thereof.

The capillary tube 151 has a smooth inner surface. The capillary tube 151 is made of a metal such as copper, aluminum and alloys thereof, and bent into a required shape. In this embodiment, the capillary tube 151 is bent to have a plurality of linear heat receiving portions 154 formed in a central area thereof and a plurality of U-shaped heat radiating portions 155 formed at two ends thereof. The heat receiving portions 154 are alternately arranged between the heat radiating portions 155. The heat receiving portions 154 cooperatively form a heating region H corresponding to the substrate 11, and the heat radiating portions 155 cooperatively form two cooling regions C for thermally connecting with the base 192 of the heat sink 19. The capillary tube 151 is hermetically sealed to form a closed loop for the working fluid 153. Alternatively, as shown in FIG. 5, the capillary tube 151 is hermetically sealed at respective ends thereof to form an open loop for the working fluid 153.

In addition, a filling tube 158 is provided adjacent to one of the cooling regions C of the capillary tube 151. After the capillary tube 151 is vacuumized, the working fluid 153 is filled into the capillary tube 151 via the filling tube 158. The working fluid 153 is usually selected from a liquid such as water, methanol, or alcohol, which has a low boiling point and is compatible with the artery mesh 152. Thus, the working fluid 153 can evaporate into vapor easily when it receives heat at the heating region H of the pulsating heat pipe 15. Since an inner diameter of the capillary tube 151 is small enough, a capillary effect exists in an interior of the capillary tube 151 so that the working fluid 153 can circulate or travel due to the effect of surface tension in the capillary tube 151. The working fluid 153 contained in the capillary tube 151 has a volume that is less than the volume of the capillary tube 151. Due to the capillary effect, the working fluid 153, once placed in the capillary tube 151, is randomly distributed in segments along the capillary tube 151 with vapor slugs between liquid slugs, thereby forming alternately arranged liquid segments 156 and vapor segments or bubbles 157.

The artery mesh 152 is an elongated hollow tube and is attached to an inner wall of the capillary tube 151 and extends along an entire length of the capillary tube 151. Alternatively, the artery mesh 152 may be divided into a plurality of spaced segments (shown in FIG. 5) and disposed in various parts of the capillary tube 151. The artery mesh 152 can be formed by weaving together a plurality of metal wires 160, such as copper wires or stainless steel wires. Alternatively, the artery mesh 152 can also be formed by weaving a plurality of non-metal threads such as fiber, or bundles of fiber. The artery mesh 152 has a ring-like transverse cross section, a diameter of which is smaller than the inner diameter of the capillary tube 151. Therefore, a first flow channel 161 is defined in an inner space of the artery mesh 152, whilst a second flow channel 162 is defined between an outer wall of the artery mesh 152 and the inner wall of the capillary tube 151. Both first and second flow channels 161, 162 are for passage of the working fluid 153. The artery mesh 152 serves as a porous wicking structure for the working fluid 153, thereby further enhancing the capillary effect for the capillary tube 151 and providing a stronger propelling force (capillary action) for circulation or traveling of the working fluid 153. A plurality of pores (not labeled) is formed in the artery mesh 152 to enable the first flow channel 161 to communicate with the second flow channel 162.

During operation, the heat generated by the LEDs 13 is conducted to the heat receiving portions 154 of the heating region H of the pulsating heat pipe 15 via the substrate 11. The heat receiving portions 154 are accordingly heated to cause the liquid segments 156 therein to vaporize and the vapor segments 157 therein to dilate. As a result, a vapor pressure is generated at the heat region H to impel the liquid and vapor segments 156, 157 to flow along the second channel 162 of the capillary tube 151 and the first channel 161 of the artery mesh 152 towards the cooling regions C which have a relatively low temperature and pressure. Simultaneously, the cooling regions C are cooled by the heat sink 19, and the vapor segments 157 in the cooling regions C are accordingly condensed into liquid after releasing the heat outwards to the heat sink 19, thereby lowering the temperature and pressure at the cooling regions C. Because of the interconnection of the heat receiving portions 154 and the heat radiating portions 155, the motions of the liquid and vapor segments 156, 157 in one tube section towards the cooling regions C also lead to the motions of the liquid and vapor segments 156, 157 in a next tube section toward the heating region H. Since the heating region H has higher temperature and higher pressure, any liquid and vapor segments 156, 157 moving toward the heating region H is subject to a restoring force. The interaction between the impelling force and the restoring force leads to oscillation or pulsation of the liquid and vapor segments 156, 157 along the capillary tube 151. A result of the pulsation of the liquid and vapor segments 156, 157 is that the heat of the LEDs 13 is continuously taken from the heating region H to the cooling regions C to dissipate by the heat sink 19. In this way, the working fluid 153 repeats the vaporization and condensation cycle in the pulsating heat pipe 15 to continuously dissipate the heat from the LEDs 13.

As shown in FIG. 2, one or more pressure sensitive one-way check valves 159 may be disposed in the particular positions of the pulsating heat pipe 15 to force the working fluid 153 to circulate in a unidirectional fashion.

In the LED lamp cooling apparatus 10, due to the pulsation motions of the liquid and vapor segments 156, 157 in the pulsating heat pipe 15, thermal resistance for heat transfer is thus reduced and a total heat flux per unit area is subsequently increased, thereby effectively addressing the dry-out problems common with conventional heat pipes or loop heat pipes, and enabling the cooling apparatus 10 to be suitable for heat dissipation for high power consumption LED lamps. In addition, when the pulsating heat pipe 15 is disposed vertically, the capillary action provided by the artery mesh 152 in the capillary tube 151 helps to conquer the gravity acting on the working fluid 153, thus driving the working fluid 153 to circulate in the capillary tube 151 more smoothly, so that the applicable range of the cooling apparatus 10 is widened.

Figure 6A:
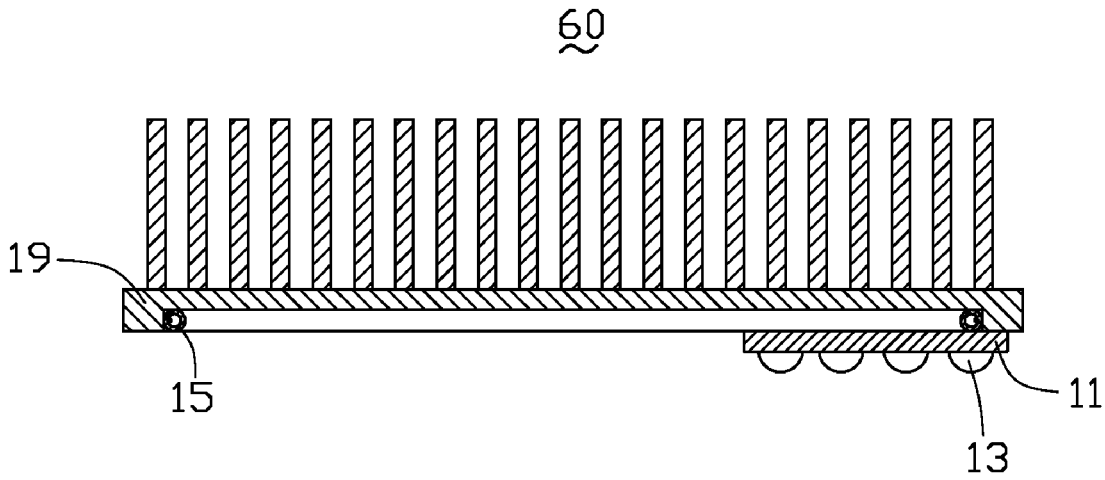
FIG. 6A is a cross-sectional view of an LED lamp cooling apparatus in accordance with a forth embodiment of the present invention.
Figure 6B:
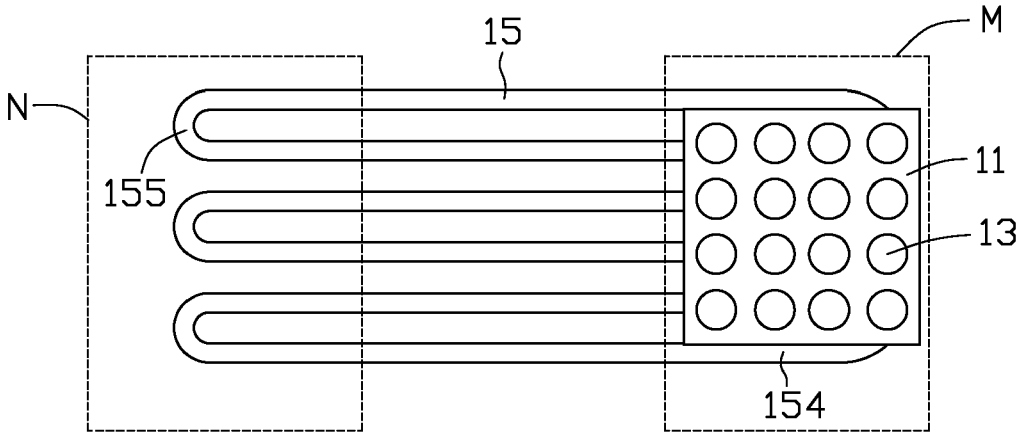
FIG. 6B is a bottom plan view of a pulsating heat pipe and a substrate of the LED lamp cooling apparatus of FIG. 6A.

FIGS. 6A-6B illustrate an LED cooling apparatus 60 in accordance with a forth embodiment of the present invention. In this embodiment, the substrate 11 on which the LEDs 13 are mounted is disposed at an end of the pulsating heat pipe 15, whereby a heating region M is formed at that end corresponding to the substrate 11 and a cooling region N is formed at the other end of the pulsating heat pipe 15. The heating region M is comprised of a plurality of U-shaped heat receiving portions 154, and the cooling region N is comprised of a plurality of U-shaped heat radiating portions 155. Other structures of the cooling apparatus 60 of this embodiment are the same as those of the cooling apparatus 10 of the previous embodiments.

Figure 7A:
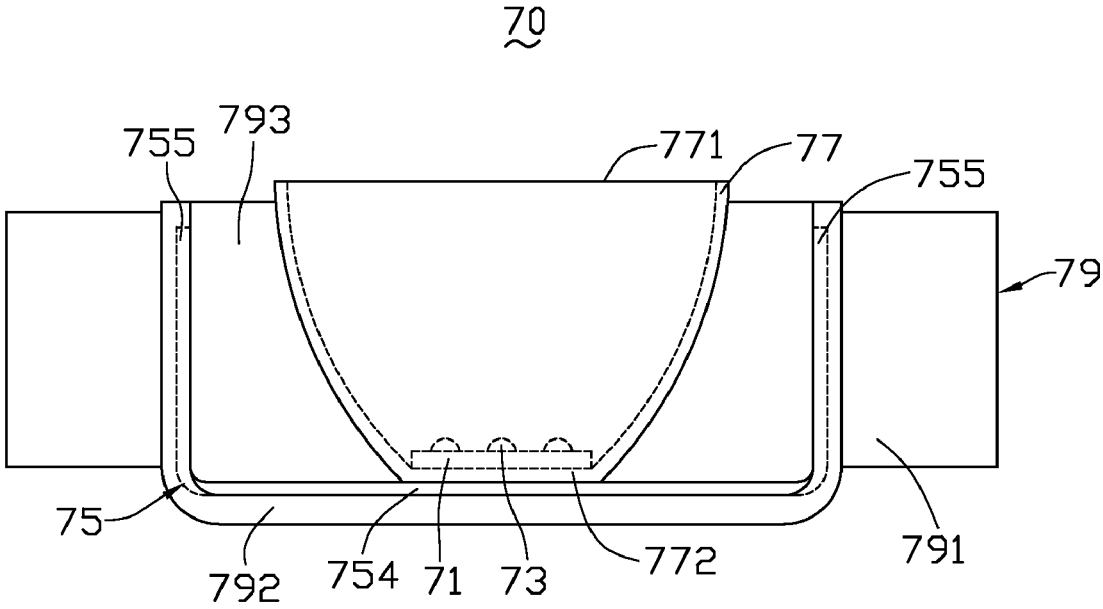
FIG. 7A is a front view of an LED lamp cooling apparatus in accordance with a fifth embodiment of the present invention.
Figure 7B:
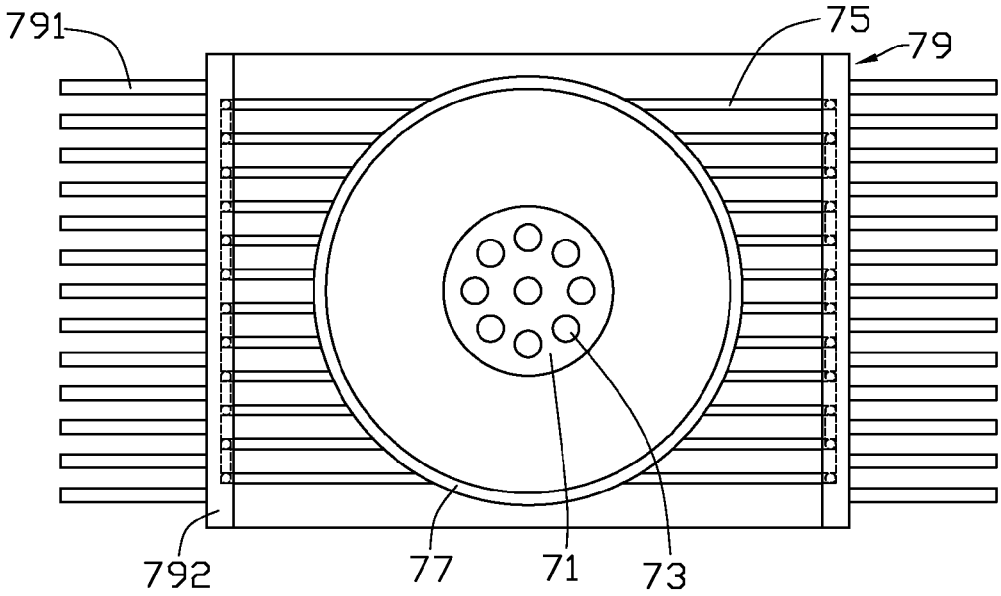
FIG. 7B is a top plan view of the LED lamp cooling apparatus of FIG. 7A.

FIGS. 7A-7B illustrate an LED cooling apparatus 70 in accordance with a fifth embodiment of the present invention. The cooling apparatus 70 includes a substrate 71, a plurality of LEDs 73 electrically connected with the substrate 71, a reflector 77 enclosing the substrate 71 and the LEDs 73, a heat sink 79 and a pulsating heat pipe 75 thermally connected with both the substrate 71 and the heat sink 79.

The reflector 77 has a cup-like shape and is made of a material of high thermal conductivity such as copper or aluminum. The reflector 77 has a bottom chassis 772 on which the substrate 71 and the LEDs 73 are disposed, and defines an opening 771 at a top end thereof acting as a light exit. An inner surface of the reflector 77 has a light-reflecting material applied thereon, so that light emitted from the LEDs 73 can be reflected and guided towards the opening 771. The heat sink 79 has a U-shaped base 792 defining a recess 793 for the reflector 77 to be accommodated therein, and a plurality of cooling fins 791 extending outwardly from an outer surface of the base 792. An orientation of the opening 771 of the reflector 77 is the same as that of the U-shaped base 792 of the heat sink 79. The pulsating heat pipe 75 is bent into a U-shaped profile and is tightly attached to and embedded in an inner surface of the base 792. Similar to the pulsating heat pipe 15 shown in FIG. 2 or FIG. 5, the pulsating heat pipe 75 has a plurality of linear heat receiving portions 754 in a central area thereof and a plurality of U-shaped heat radiating portions 755 at two ends thereof. The heat receiving portions 754 are sandwiched between the chassis 772 of the reflector 77 and the base 792 of the heat sink 79. Alternatively, the chassis 772 can be omitted to directly attach the substrate 71 on which the LEDs 73 are disposed to the heat receiving portions 754 of the pulsating heat pipe 75 for decreasing heat resistance therebetween.

In the present LED lamp cooling apparatus 70, the heat generated by the LEDs 73 is transferred from the substrate 71 to the chassis 772 of the reflector 77 and then to the heat receiving portions 754 of the pulsating heat pipe 75. Afterwards, the pulsating heat pipe 75 transfers the heat from the heat receiving portions 754 thereof to the heat radiating portions 755 thereof and then to the cooling fins 791 of the heat sink 79. In that way, a part of the heat is dissipated into surrounding atmosphere via the reflector 77, and another part of the heat is dissipated via the heat sink 79. Accordingly, the heat dissipation surface area is increased and the heat dissipation efficiency of the cooling apparatus 70 is improved.

Figure 8A:
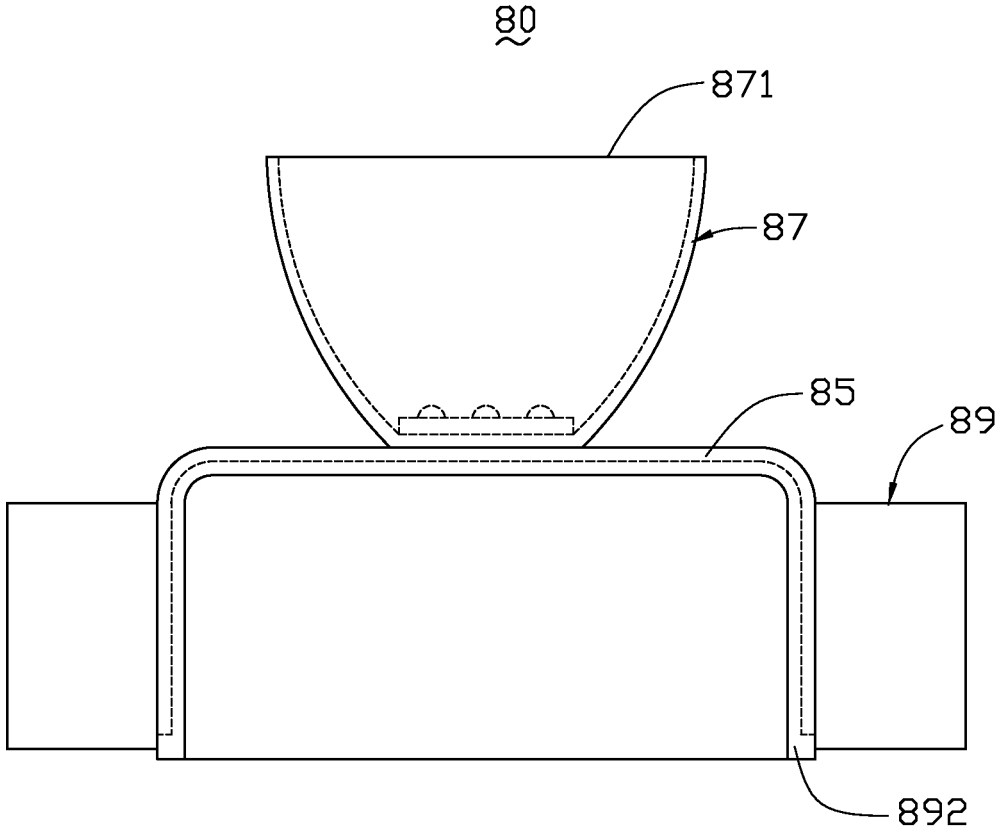
FIG. 8A is a front view of an LED lamp cooling apparatus in accordance with a sixth embodiment of the present invention.
Figure 8B:
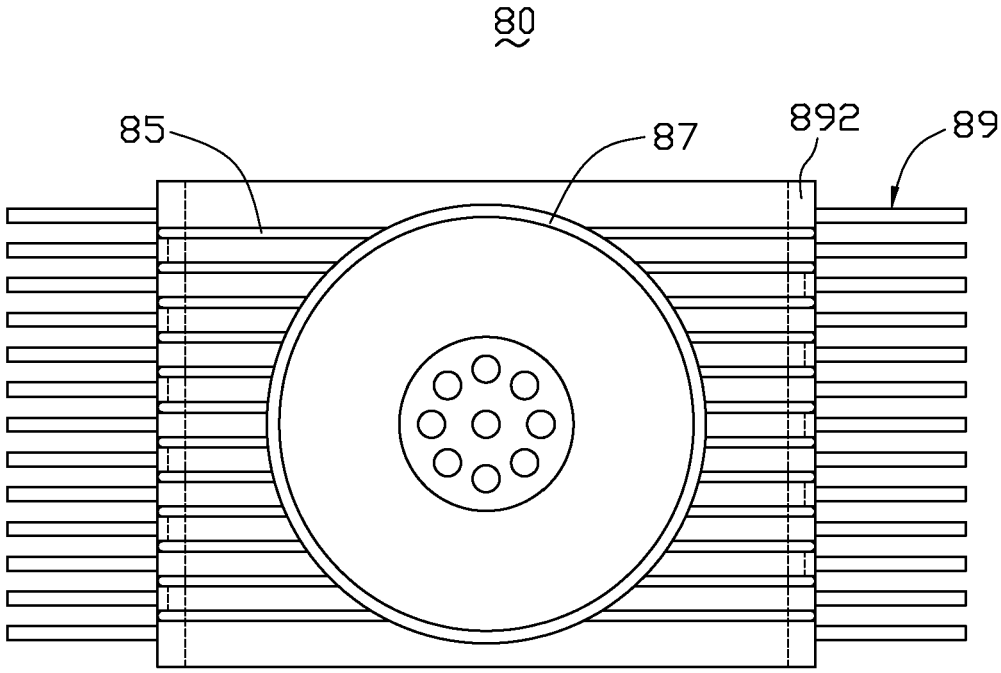
FIG. 8B is a top plan view of the LED lamp cooling apparatus of FIG. 8A.

FIGS. 8A-8B illustrate an LED lamp cooling apparatus 80 in accordance with a sixth embodiment of the present invention. In the present cooling apparatus 80, the pulsating heat pipe 85 is attached to an outer surface of the U-shaped base 892 of the heat sink 89. The reflector 87 is disposed on and thermally connects with the heat sink 89 via the pulsating heat pipe 85. Namely, the orientation of the opening 871 of the reflector 77 is opposite to that of the U-shaped base 892 of the heat sink 89. Other structures of the cooling apparatus 80 of this embodiment are the same as those of the cooling apparatus 70 of the fifth embodiment shown in FIGS. 7A-7B.

Figure 9A:
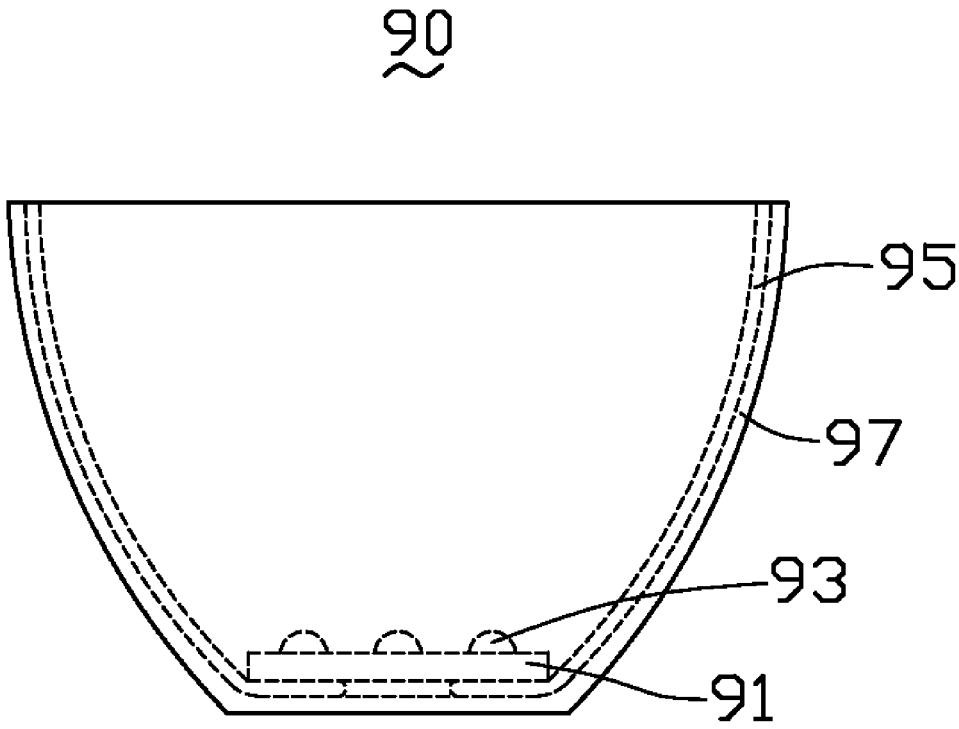
FIG. 9A is a front view of an LED lamp cooling apparatus in accordance with a seventh embodiment of the present invention.
Figure 9B:
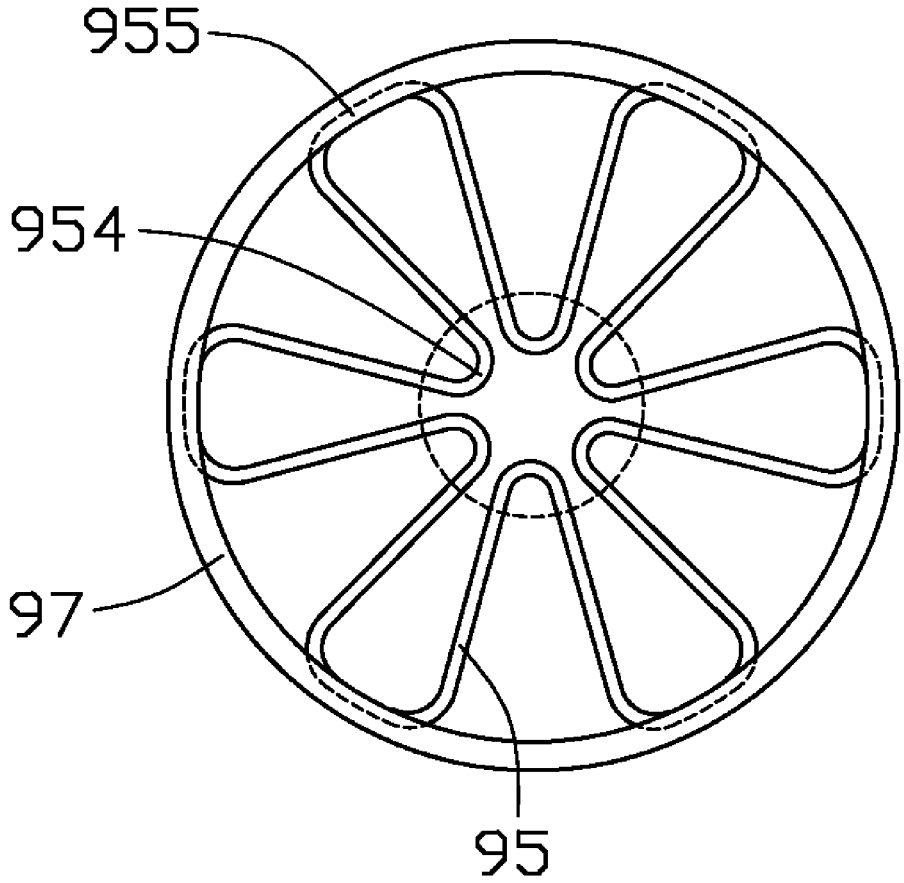
FIG. 9B is a top plan view of the LED lamp cooling apparatus of FIG. 9A, with a substrate thereof being removed.
Figure 9C:
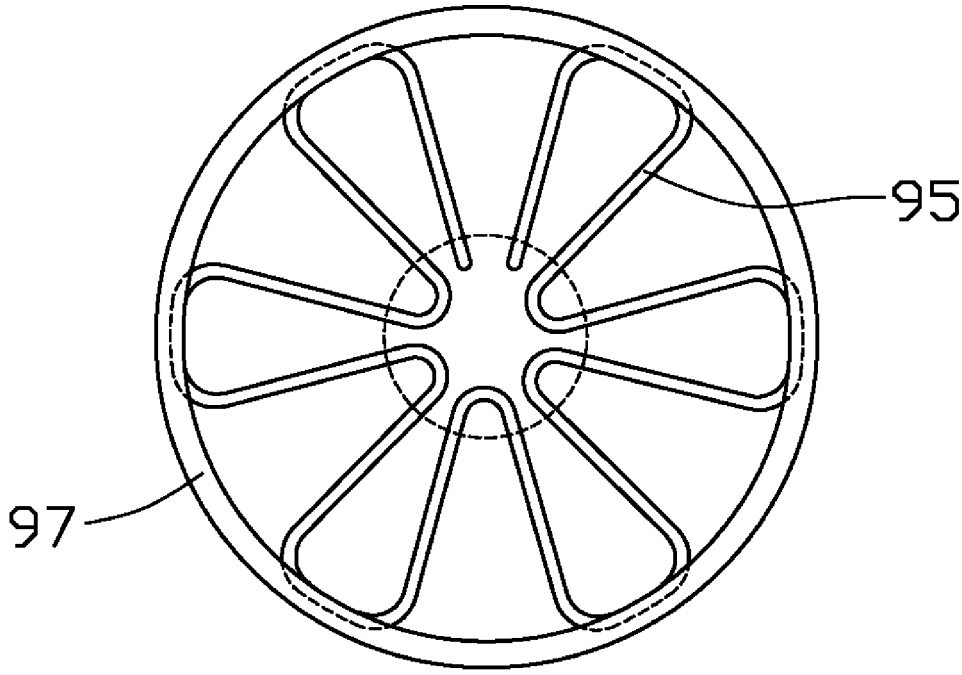
FIG. 9C is similar to FIG. 9B, but showing a modification thereof.

FIGS. 9A-9B illustrate an LED lamp cooling apparatus 90 in accordance with a seventh embodiment of the present invention. In this embodiment, the pulsating heat pipe 95 is formed as a closed loop and is configured to have a shape conforming to the U-shaped profile of the reflector 97. Alternatively, the pulsating heat pipe 95 can also be an open loop as shown in FIG. 9C. The pulsating heat pipe 95 has a plurality of U-shaped heat receiving portions 954 in a central area thereof and a plurality of U-shaped heat radiating portions 955 at a circumference thereof. The reflector 97 is made of a highly thermally conductive material such as copper, aluminum or alloys thereof, and the pulsating heat pipe 95 is tightly and thermally attached to or embedded in an inner surface of the reflector 97. The heat receiving portions 954 and heat radiating portions 955 are evenly distributed across the inner surface of the reflector 97. The LEDs 93 are disposed on and electrically connects with the substrate 91. The substrate 91 is directly attached to the heat receiving portions 954 of the pulsating heat pipe 95. The heat generated by the LEDs 93 is transferred from the substrate 91 to the reflector 97 via the pulsating heat pipe 95. Besides the function of reflection and guidance of light from the LEDs 93, the reflector 97 also functions as a heat sink for heat dissipation. In that way, the heat sink is integrated with the reflector, thereby simplifying the whole structure of the cooling apparatus 90.

Figure 9D:
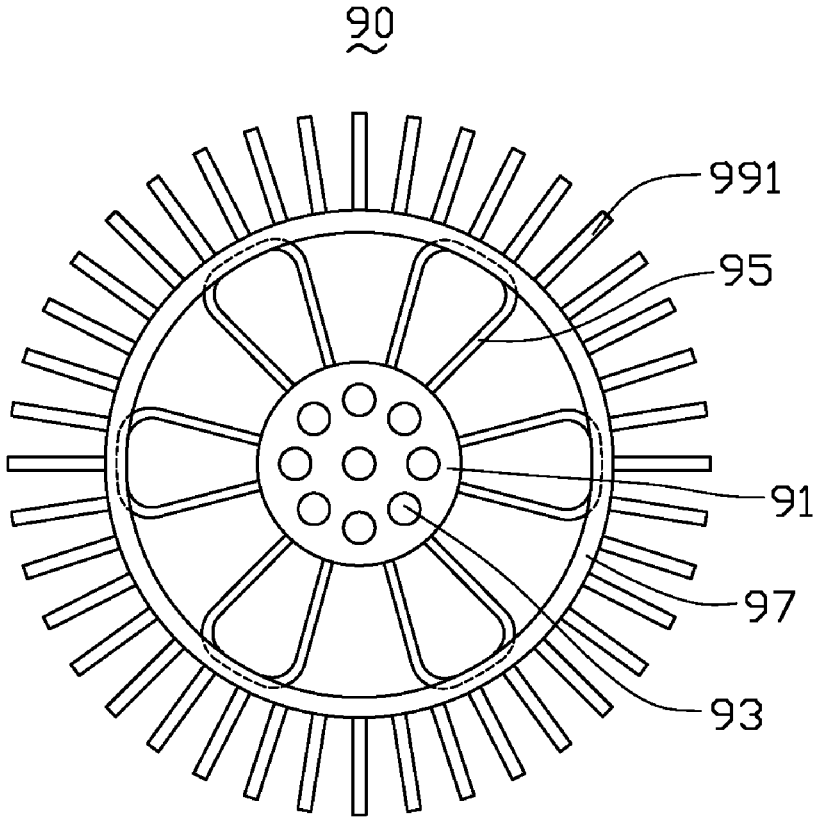
FIG. 9D is a top plan view of the LED lamp cooling apparatus of FIG. 9A, together with a plurality of cooling fins attached thereto.

In addition, a plurality of cooling fins 991 can be attached to an outer surface of the reflector 97 for increasing heat dissipation surface area and improving heat dissipation efficiency of the cooling apparatus 90, as shown in FIG. 9D.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp cooling apparatus comprising:

a substrate on which at least one LED is mounted;

a heat sink for dissipation of heat generated by the at least one LED; and a pulsating heat pipe having a plurality of heat receiving portions and a plurality of heat radiating portions, and containing a working fluid therein, the substrate being attached to the heat receiving portions of the pulsating heat pipe and the heat sink being attached to the heat radiating portions of the pulsating heat pipe, the heat generated by the at least one LED being transferred from the heat receiving portions to the heat radiating portions of the pulsating heat pipe through pulsation of the working fluid in the pulsating heat pipe;

wherein an artery mesh is disposed in the pulsating heat pipe, and the artery mesh defines a hollow flow channel therein.

2. The LED lamp cooling apparatus of claim 1 further comprising a reflector in which the at least one LED and the substrate are enclosed.

3. The LED lamp cooling apparatus of claim 2, wherein the heat sink is enclosed within a chamber defined by the reflector.

4. The LED lamp cooling apparatus of claim 2, wherein a part of the heat sink is enclosed in the reflector, and another part of the heat sink extends out of the reflector.

5. The LED lamp cooling apparatus of claim 1, wherein the heat sink comprises a base and a plurality of cooling fins attached to the base, the base defining a groove for the pulsating heat pipe to be embedded in.

6. The LED lamp cooling apparatus of claim 5, wherein the base of the heat sink is U-shaped, and the pulsating heat pipe is bent to form a plurality of U-shaped tube sections each being attached to an inner surface of the base.

7. The LED lamp cooling apparatus of claim 5, wherein the base of the heat sink is U-shaped, and the pulsating heat pipe is bent to form a plurality of U-shaped tube sections each being attached to an outer surface of the base.

8. The LED lamp cooling apparatus of claim 1, wherein the heat sink has a cup-like profile and functions as a reflector for reflection of light emitted from the at least one LED, the at least one LED and the substrate being enclosed in the heat sink.

9. The LED lamp cooling apparatus of claim 8, wherein the heat receiving portions and the heat radiating portions are evenly distributed across an inner surface of the heat sink.

10. The LED lamp cooling apparatus of claim 1, wherein the heat receiving portions of the pulsating heat pipe are linear and the heat radiating portions of the pulsating heat pipe are U-shaped.

11. The LED lamp cooling apparatus of claim 1, wherein each of the heat receiving portions and heat radiating portions of the pulsating heat pipe is U-shaped.

12. The LED lamp cooling apparatus of claim 1, wherein the artery mesh is attached to an inner surface of the pulsating heat pipe, and a diameter of the artery mesh is smaller than that of the pulsating heat pipe.

13. The LED lamp cooling apparatus of claim 1, wherein the artery mesh is formed by weaving a material selected from a group consisting of copper wires, stainless steel wires, fiber and bundles of fiber.

14. The LED lamp cooling apparatus of claim 1, wherein the pulsating heat pipe is formed as a closed loop or an open loop.

15. An LED lamp cooling apparatus comprising:

a substrate;

a plurality of LEDs mounted on the substrate;

a pulsating heat pipe having a heat receiving portion in thermal connection with the LEDs and a heat radiation portion; and a heat sink in thermal connection with the heat radiation portion of the pulsating heat pipe;

wherein the pulsating heat pipe has working fluid therein, the working fluid having alternate liquid and vapor segments, the fluid moving from the heat receiving portion to the heat releasing portion in a pulsating manner when the heat receiving portion receives heat from the LEDs; and wherein the LED lamp cooling apparatus further comprises a reflector for reflecting light generated by the LEDs to a specific spot.

16. The LED lamp cooling apparatus of claim 15, wherein the heat sink has fins extending upwardly, and the reflector directs the light generated by the LEDs downwardly.

17. The LED lamp cooling apparatus of claim 15, wherein the pulsating heat pipe has a flexible interwoven artery mesh disposed therein, the mesh having a ring-like transverse cross section.

18. An LED lamp cooling apparatus comprising:

a substrate;

a plurality of LEDs mounted on the substrate;

a pulsating heat pipe having a heat receiving portion in thermal connection with the LEDs and a heat radiation portion; and a heat sink in thermal connection with the heat radiation portion of the pulsating heat pipe;

wherein the pulsating heat pipe has working fluid therein, the working fluid having alternate liquid and vapor segments, the fluid moving from the heat receiving portion to the heat releasing portion in a pulsating manner when the heat receiving portion receives heat from the LEDs; and wherein the heat sink also functions as a reflector for reflecting light generated by the LEDs to a specific spot.

* * * * *